US008499483B2

(12) United States Patent
Quaedpeerds et al.

(10) Patent No.: US 8,499,483 B2
(45) Date of Patent: Aug. 6, 2013

(54) BUTT WITH RECOIL PAD FOR A SHOULDER-HELD FIREARM

(75) Inventors: Eric Quaedpeerds, Bassenge (BE); Thierry Dumortier, Hermee (BE)

(73) Assignee: Browning International., Societe Anonyme, Herstal (BE)

( * ) Notice: Subject to any disclaimer, the term of this patent is extended or adjusted under 35 U.S.C. 154(b) by 0 days.

(21) Appl. No.: 13/534,156

(22) Filed: Jun. 27, 2012

(65) Prior Publication Data

US 2013/0000175 A1 Jan. 3, 2013

(30) Foreign Application Priority Data

Jun. 28, 2011 (BE) ..... 2011/0392
May 14, 2012 (EP) ..... 12003789

(51) Int. Cl.
*F41C 23/08* (2006.01)
*F41C 23/14* (2006.01)

(52) U.S. Cl.
USPC ..... 42/73

(58) Field of Classification Search
USPC ..... 42/71.01–74, 75.01
See application file for complete search history.

(56) References Cited

U.S. PATENT DOCUMENTS

| | | | | | |
|---|---|---|---|---|---|
| 243,553 | A | * | 6/1881 | Oliver et al. | 42/73 |
| 843,227 | A | * | 2/1907 | Munson | 42/73 |
| 1,468,354 | A | | 9/1923 | Caretto | |
| 1,480,350 | A | * | 1/1924 | Martin et al. | 42/74 |
| 2,453,394 | A | * | 11/1948 | Wittman | 42/73 |
| 2,631,398 | A | * | 3/1953 | Fantoni | 42/73 |
| 2,754,608 | A | * | 7/1956 | Stieffel, Jr. | 42/74 |
| 4,300,302 | A | * | 11/1981 | Anschutz et al. | 42/73 |

FOREIGN PATENT DOCUMENTS

| | | | |
|---|---|---|---|
| DE | 9411466 | U1 | 11/1994 |
| DE | 202007012495 | U1 | 12/2007 |
| EP | 1688696 | A1 | 8/2006 |

* cited by examiner

*Primary Examiner* — Bret Hayes
*Assistant Examiner* — Reginald Tillman, Jr.
(74) *Attorney, Agent, or Firm* — Bacon & Thomas, PLLC

(57) ABSTRACT

Butt with recoil pad for a shoulder-held firearm, with the butt comprising a recoil pad, characterized in that the recoil pad is mounted on the butt by means enabling the position of the recoil pad to be adjusted with respect to the butt so as to be able to personalize the position of the recoil pad for the shooter with respect to an average position in which the recoil pad is primarily located in the extension of the butt.

18 Claims, 11 Drawing Sheets

BUTT WITH RECOIL PAD FOR A SHOULDER-HELD FIREARM

FIELD OF THE INVENTION

The invention concerns a butt with recoil pad for a shoulder-held firearm, for example for a rifle or a shotgun.

BACKGROUND OF THE INVENTION

A shoulder-held firearm is fitted with a butt to press the weapon against the shoulder and/or against the cheek of the shooter.

A disadvantage of this type of weapon is that, when firing, the shoulder of the shooter experiences a rather violent impact because of the recoil of the weapon due to the reaction forces from the gases formed by the ignition of the powder of the struck cartridge, whose bullet or shot is expelled from the barrel by the propulsion of these gases.

Another disadvantage linked to the recoil forces is that the shooter becomes a little unbalanced upon each shot fired, which is reflected in the fact that he must regain his balance each time in order to be in a stable position for the next shot.

This results in a lack of accuracy of the shot or a reduced rate of fire and a lack of comfort for the shooter.

In order to provide a certain comfort when firing, different shock-absorption systems are known to be used, such as a flexible protector rigidly affixed to the body of the butt and covering the rear part of the butt body, with such a protector being known by the name of recoil pad.

Despite the presence of a recoil pad, the forces that the shooter must take in his shoulder remain substantial.

The effect of the recoil may be also alleviated by personalising the recoil pad to the measurements of the user.

This solution is expensive and requires the intervention of an expert.

The weapon can only be adapted for the firing comfort of a single person.

The effect differs according to the clothes worn by the shooter, for example.

In general the recoil pad is not personalised for the shooter, especially if the weapon is used by several users.

The utility model DE 20.2007.012.495 discloses a butt which is provided at the rear with an assembly with a plurality of elements of which the position can be adapted to the shoulder of the shooter, the assembly being able to be rotated laterally around a shaft without clamping by means of a hook which is fixed to the shaft. The mechanism is very complex and adjustment to the shoulder is complex and difficult.

U.S. Pat. No. 1,468,354 discloses a butt in two parts of which the rear part, which is meant for being held against the shoulder of the shooter, is mounted an a swivel which allows to position the rear part in several positions with respect to the front part of the butt, the rear part being forced in a neutral position by means of springs positioned between the two parts of the butt. The rear part cannot be blocked in position on the front part.

SUMMARY OF THE INVENTION

The objective of the invention is to remedy the above-mentioned disadvantages and to reduce the recoil on the shoulder in order to provide greater comfort for the shooter and enable more precise handling of the weapon.

This objective is achieved by the development of a butt with a recoil pad mounted on the rear of the body of the butt by means of a single ball joint enabling the position of the recoil pad to be adjusted with respect to the body of the butt so as to be able to personalise the position of the recoil pad for the shooter with respect to an average position in which the recoil pad is located, primarily in the extension of the body of the butt and primarily in a position transverse to the average axis of symmetry of the body of the butt, wherein the ball joint is formed by a spherical protuberance of the recoil pad or of the butt, with this protuberance being housed in a spherical hollow of the butt or the recoil pad respectively, the spherical hollow being formed by a wall, with the spherical protuberance being retained in the spherical hollow by means of a bolt going through the wall through an opening and by means of a nut into which the bolt is screwed.

A butt according to the invention enables a practically perfect and simple adaptation of the recoil pad against the body of the shooter.

This recoil pad is adjusted in order to mould to the body of the shooter. Because of this, the surface in contact with the body of the shooter is very greatly increased with respect to a butt with a fixed recoil pad. The contact surface can be increased by a factor of twenty.

In this way, the recoil force of the weapon is spread over a much larger contact area between the recoil pad and the shoulder of the shooter, which reduces the pressure felt by the shooter and thus the negative effects of the recoil force.

In addition to the fact of reducing the pressure on the body, the system according to the invention enables the shooter to merge with his weapon. This provides a better firing sensation. In the same way as if he had had a butt made according to his measurements, the shooter can personalise his weapon.

The system according to the invention is fitted to the shooter, irrespective of the conditions and little matter whether the shooter is wearing light or thick clothing.

According to the invention, the above-mentioned means are realised by a single ball joint that is preferably mounted in the centre of the rear surface of the body of the butt and enables the recoil pad to be pivoted around at least one axis of rotation, and preferably around three orthogonal axes.

Such a ball joint enables the position of the recoil pad to be adapted to practically any morphological situation of the shooter, the clothes worn by the shooter, and so on.

In a practical way, the ball joint can be locked so as to fix the ball joint into position in order to lock the position of the recoil pad with respect to the body of the butt in a position suitable for the shooter.

According to the invention, the locking is done by means of a clamping bolt whose head can be accessed from the outside for a tightening tool, for example a hex key through a passage in the recoil pad.

The locking and unlocking is thus easy and appropriate and does not require a lot of manipulation to change the position of the recoil pad.

Optionally the butt can be supplemented by a set of spacers enabling the length of the butt to be changed.

The invention also concerns a recoil pad assembly comprising a base plate for fitting to the rear of the body of a butt of a shoulder-held firearm and comprising a recoil pad mounted on the base plate by means of a single ball joint enabling the position of the recoil pad to be adjusted with respect to the base plate so as to be able to personalise the position of the recoil pad for the shooter with respect to an average position.

Such an assembly may be mounted on the rear of the body of the butt instead of a traditional fixed recoil pad, enabling the recoil pad to be adapted to the morphology of the shooter.

BRIEF DESCRIPTION OF THE DRAWINGS

For greater clarity, a few example embodiments of a butt with recoil pad according to the invention for a shoulder-held firearm are described hereinafter by way of an example and without any limiting nature, with reference to the accompanying drawings, wherein.

DETAILED DESCRIPTION OF A PREFERRED EMBODIMENT

Figure 1:
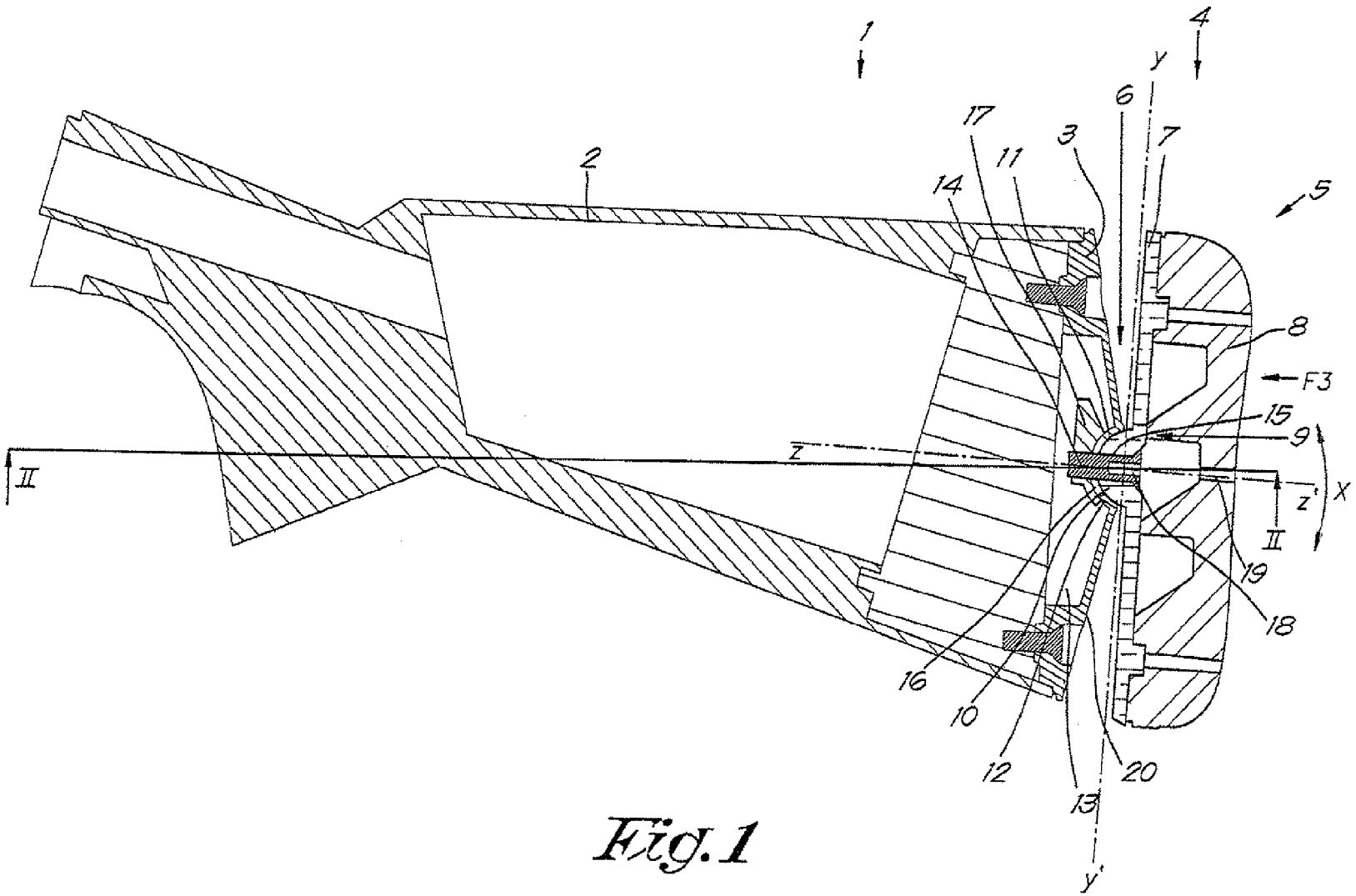
FIG. 1 shows a schematic longitudinal cross-section of a butt with a recoil pad according to the invention.

The butt 1 according to the invention shown in FIG. 1 comprises a body 2 and a base plate 3 mounted on the rear of the body 2 of the butt.

The base plate 3 forms part of a recoil pad assembly 4, also comprising a recoil pad 5 mounted on the base plate 3 by means 6 enabling the position of the recoil pad 5 to be adjusted with respect to the base plate 3 and thus with respect to the butt 1.

The recoil pad 5 consists of a support plate 7 and a pad 8 of a flexible composition enabling the recoil impact of the weapon to be partly absorbed when firing.

This type of recoil pad 5 is generally known but it is usually applied in a fixed way directly to the rear of the butt 1.

In the example shown, the means 6 enabling the position of the recoil pad 5 to be adjusted are formed by a single ball joint 9, which is formed by a spherical protuberance 10 of the support plate 7 of the recoil pad 5, with this protuberance 10 being housed in a concentric spherical hollow 11 of the base plate 3 of the butt 1.

The spherical hollow 11 is formed by a wall 12 of the base plate delimiting a cavity 13 of the base plate 3 of the butt 1, with the spherical protuberance 10 being retained in the spherical hollow 11 by means of a bolt 14 going through the protuberance 10 and the wall 12 through a radial passage 15 in the spherical protuberance 10 and through an opening 16 in the wall 12 respectively.

The bolt 14 is screwed into a nut 17 housed in the cavity 13 of the other side of the wall 12, with the travel of the bolt 14 being sufficient to enable the position of the ball joint 9 to be locked in any desired position.

The passage 15 is preferably a cylindrical passage whose diameter essentially corresponds to the diameter of the bolt 14, while the opening 16 is characterised by larger dimensions than the diameter of the bolt 14, so that the bolt 14 can move in this opening 16 through the operation of the ball joint 9.

The head of the bolt has a hexagonal orifice 18 for a hex key, with the orifice being accessible from the outside through a passage 19 in the recoil pad 5.

The ball joint 9 is located essentially in the centre of the base plate 3 and at the centre of the support plate 7 of the recoil pad 5.

The rear surface 20 of the butt 1 formed by the rear surface of the base plate 3 has a convergent conical shape towards the outside. The ball joint 9 is located at the point of convergence of this surface 20.

Figure 2:
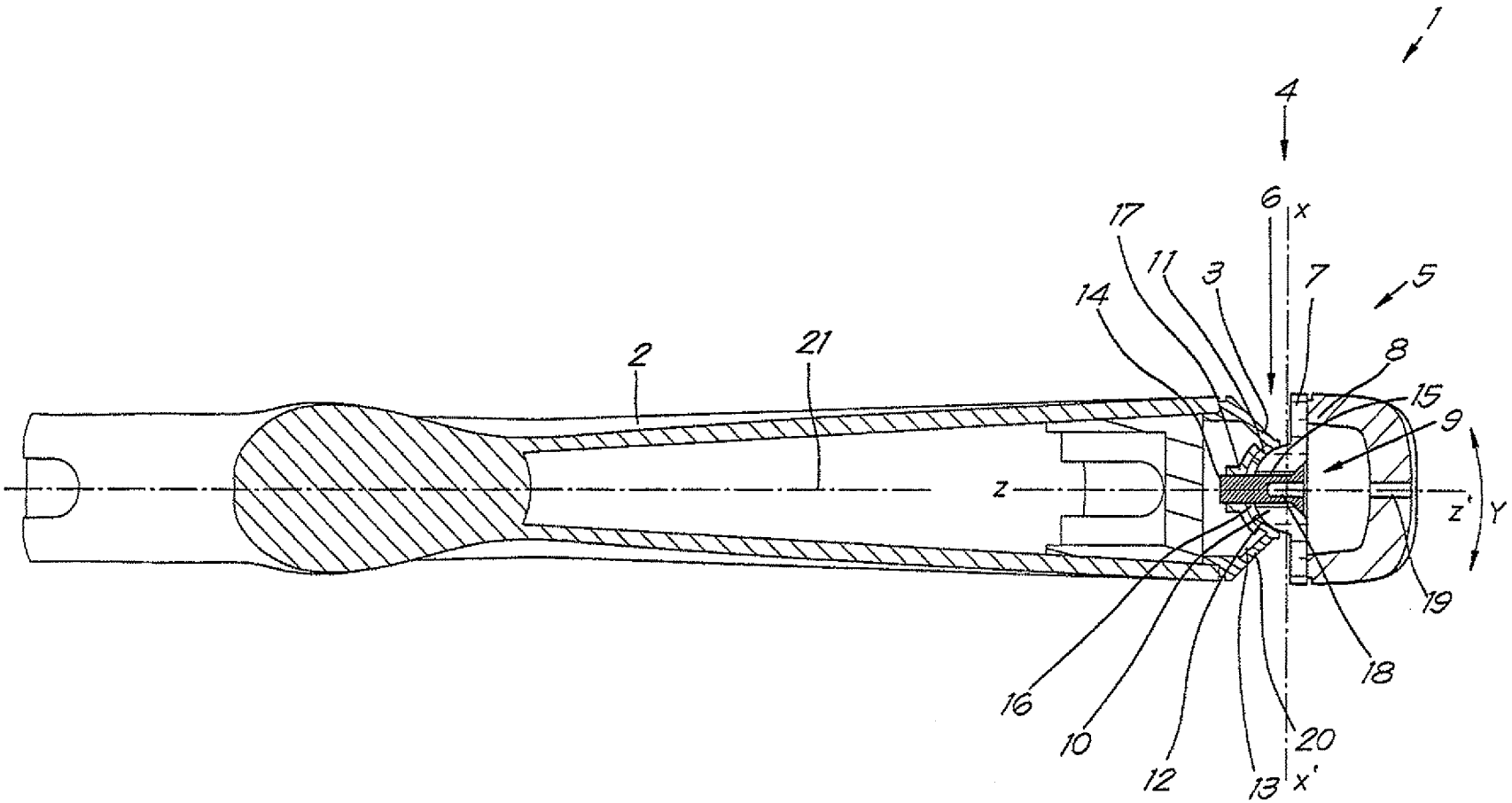
FIG. 2 shows a cross-section according to line II-II of FIG. 1.
Figure 3:
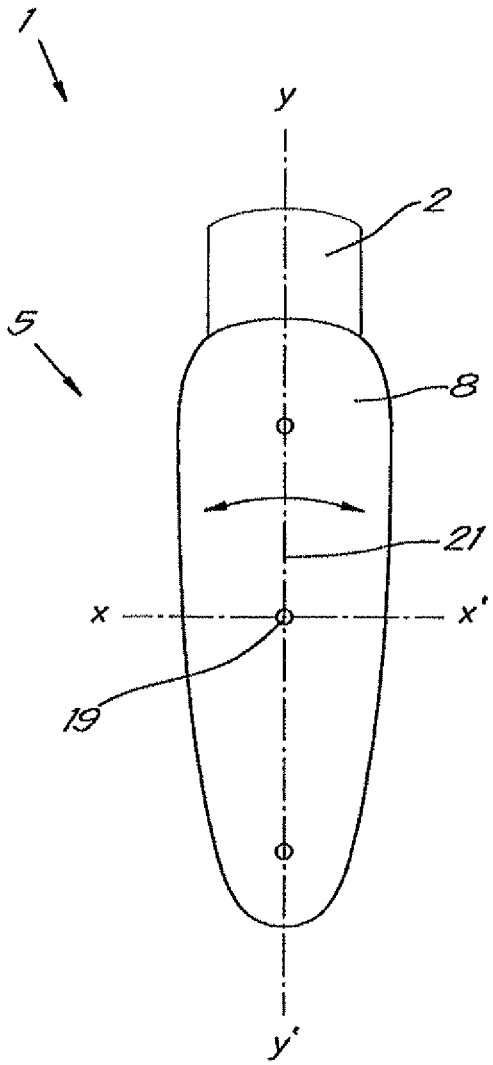
FIG. 3 shows a rear view in the direction of the arrow F3 of FIG. 1.

The ball joint 9 enables the position of the recoil pad 5 to be adjusted with respect to the butt so as to be able to personalise the position of the recoil pad 5 for the shooter with respect to an average neutral position shown in FIGS. 1 to 3 in which the recoil pad 5 is primarily located in the extension of the butt.

Figure 4:
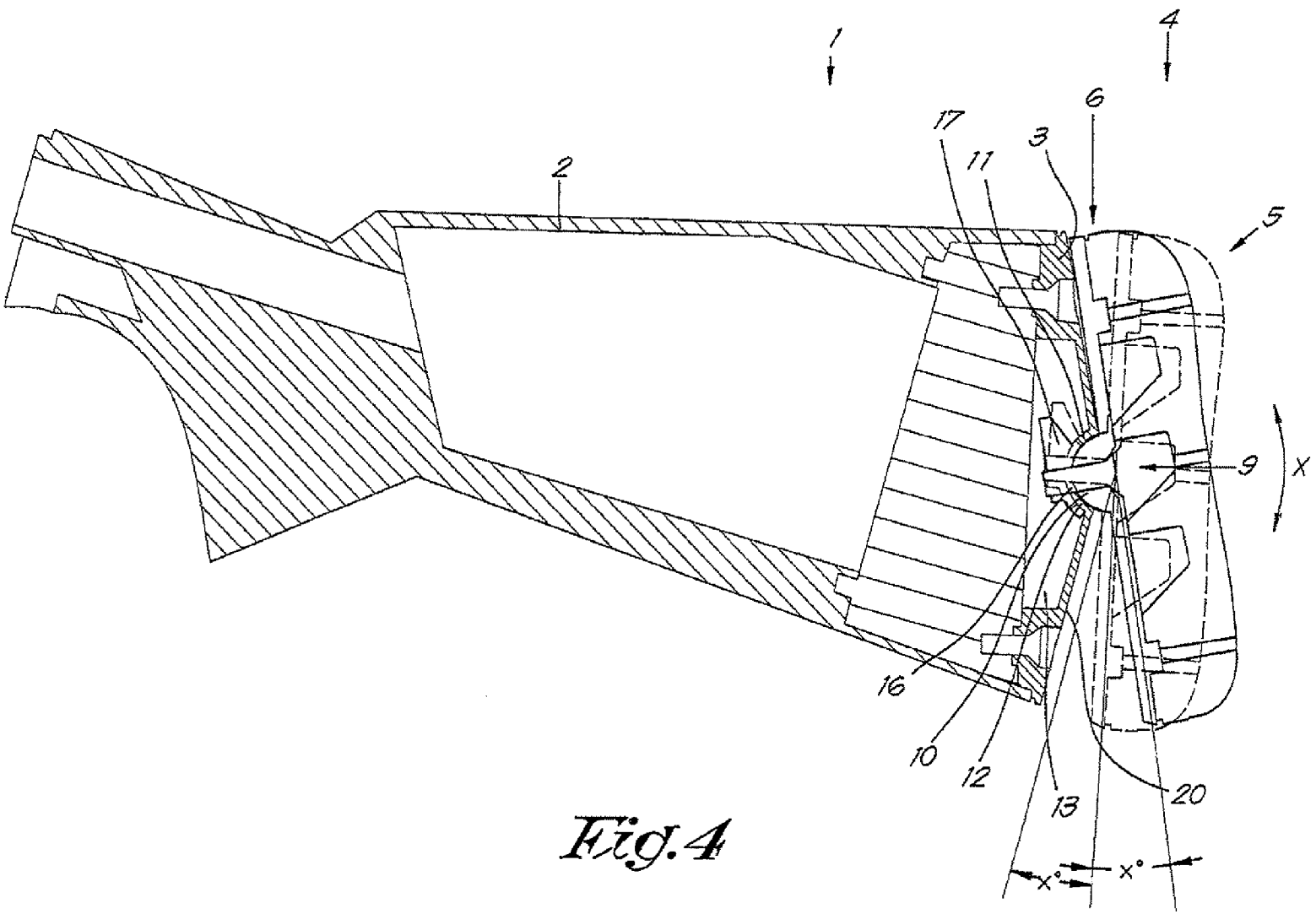
FIGS. 4 to 6 show similar views to those of FIGS. 1 to 3 respectively, but for a position of the recoil pad.
Figure 5:
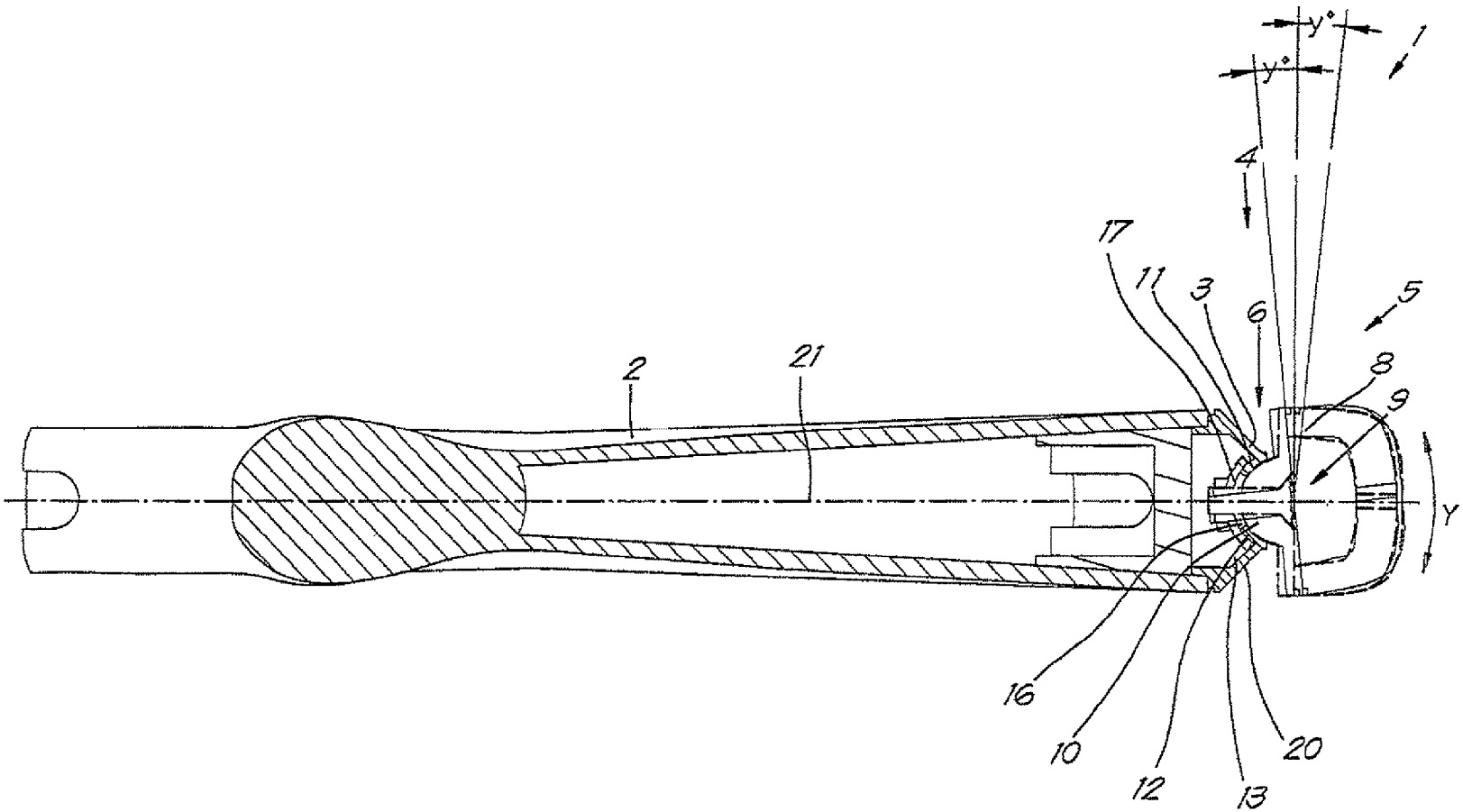
Figure 6:
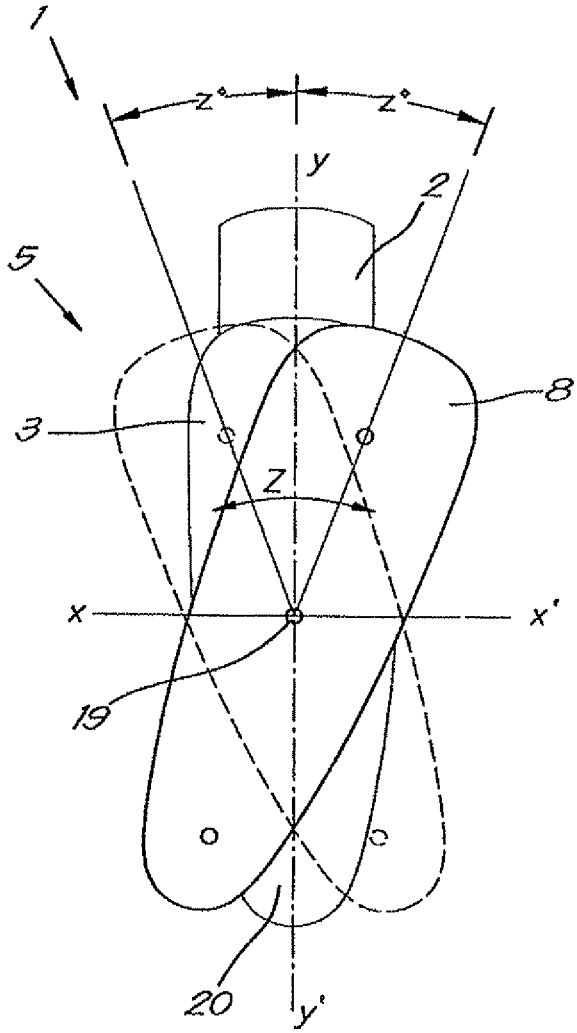

More specifically, the ball joint enables a rotation around three orthogonal axes, respectively:

- An X rotation to adjust the incline of the recoil pad 5 in the average plane of symmetry 21 of the butt 1, i.e. an X rotation around a transverse axis X-X' perpendicular to the average plane of symmetry 21 of the butt 1 as illustrated in FIG. 4.
- A lateral Y rotation around a yaw axis Y-Y' primarily located in the average plane of symmetry 21 of the butt 1, for example parallel to the support plate 7 as illustrated in FIG. 5.
- A Z rotation around a longitudinal axis Z-Z' perpendicular to the axes X-X' and Y-Y' as illustrated in FIG. 6.

The conical shape of the rear surface 20 limits the rotations around the axes X-X' and Y-Y', with this surface forming an end stop for the support plate 7.

The rotation possibilities may also or alternatively be limited by the shape of the opening 16, limiting the movements of the bolt 14 in this opening 16.

The maximum angle of rotation X° around the transverse axis X-X' is preferably at least five degrees or better still at least ten degrees and preferably around thirteen degrees with respect to the average position.

The maximum angle of rotation Y° around the yaw axis Y-Y' is preferably at least four degrees or better still at least six degrees and preferably around eight degrees with respect to the average position.

The maximum angle of rotation Z° around the longitudinal axis Z-Z' is preferably at least ten degrees or better still at least twenty degrees and preferably between twenty and twenty five degrees with respect to the average position.

It is clear that in the case of the ball joint 9, the axes X-X', Y-Y' and Z-Z' essentially intersect at a point, which is absolutely not necessary for the invention but which facilitates the adjustment and which enables a better distribution of the recoil force on the shoulder of the shooter.

The invention does not exclude limiting the number of axes of rotation and only enabling a rotation around a single axis, for example the Y-Y' axis, or around two axes, for example the Y-Y' and Z-Z' axes, and preventing other rotations.

It is clear that the rotation around the different axes of rotation X-X', Y-Y' and Z-Z' may be done simultaneously and that the locking can be done quite simply by tightening the bolt 14. However it is not excluded that each rotation is done by an articulation and lock that are independent from the other.

Figure 7:
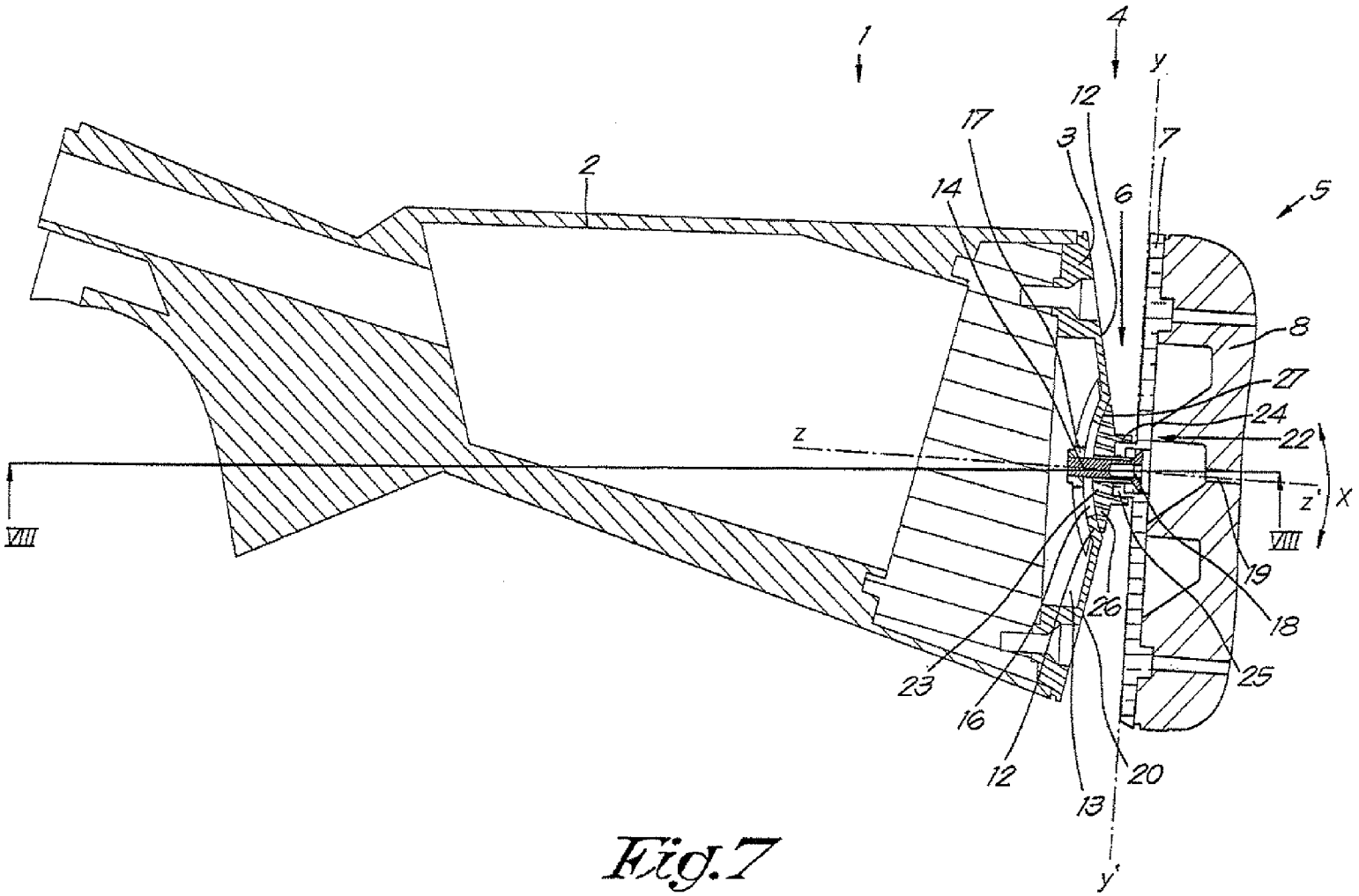
FIG. 7 shows a longitudinal cross-section similar to FIG. 1, but for a different embodiment of a butt with recoil pad according to the invention.
Figure 8:
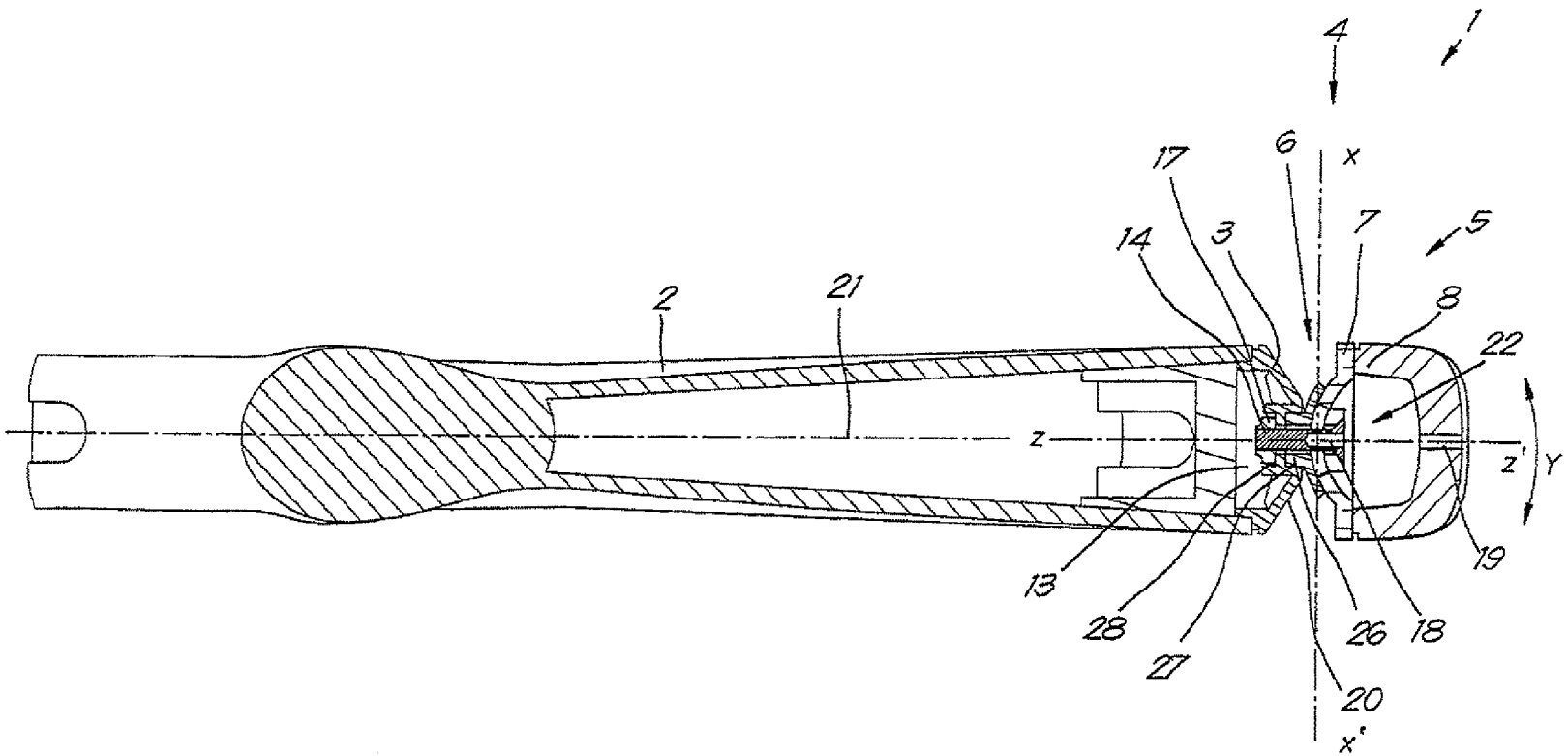
FIG. 8 is a cross-section according to line VII-VII of FIG. 7.

FIGS. 7 and 8 show an example of such an embodiment in which the spherical ball joint 9 is replaced by a double articulation 22 which enables a rotation of the recoil pad around two orthogonal axes, respectively around the transverse axis X-X' and around the yaw axis Y-Y'.

This double articulation 22 is realised by an intermediate part 23, which on the one hand has a groove 24 whose base is rounded concavely to enable the sliding of a protuberance 25 of the support plate 7 in the form of a segment of a circle that can pivot in the groove 24 around the Y-Y' axis, and which on the other hand has the form of a segment of a circle 26 that can pivot analogously in a rounded groove 27 made on the outside of the wall 12 of the base plate 3 for pivoting around the X-X' axis.

The intermediate part is held in place by a bolt 14 going through the support plate 7, the intermediate part 23 and the wall 12 of the base plate 3 and by a nut 17 inside the wall 12, with the nut 17 being guided in a groove 28.

The double articulation 22 is locked by tightening the bolt 14 whose head is accessible through the passage 19.

Figure 9:
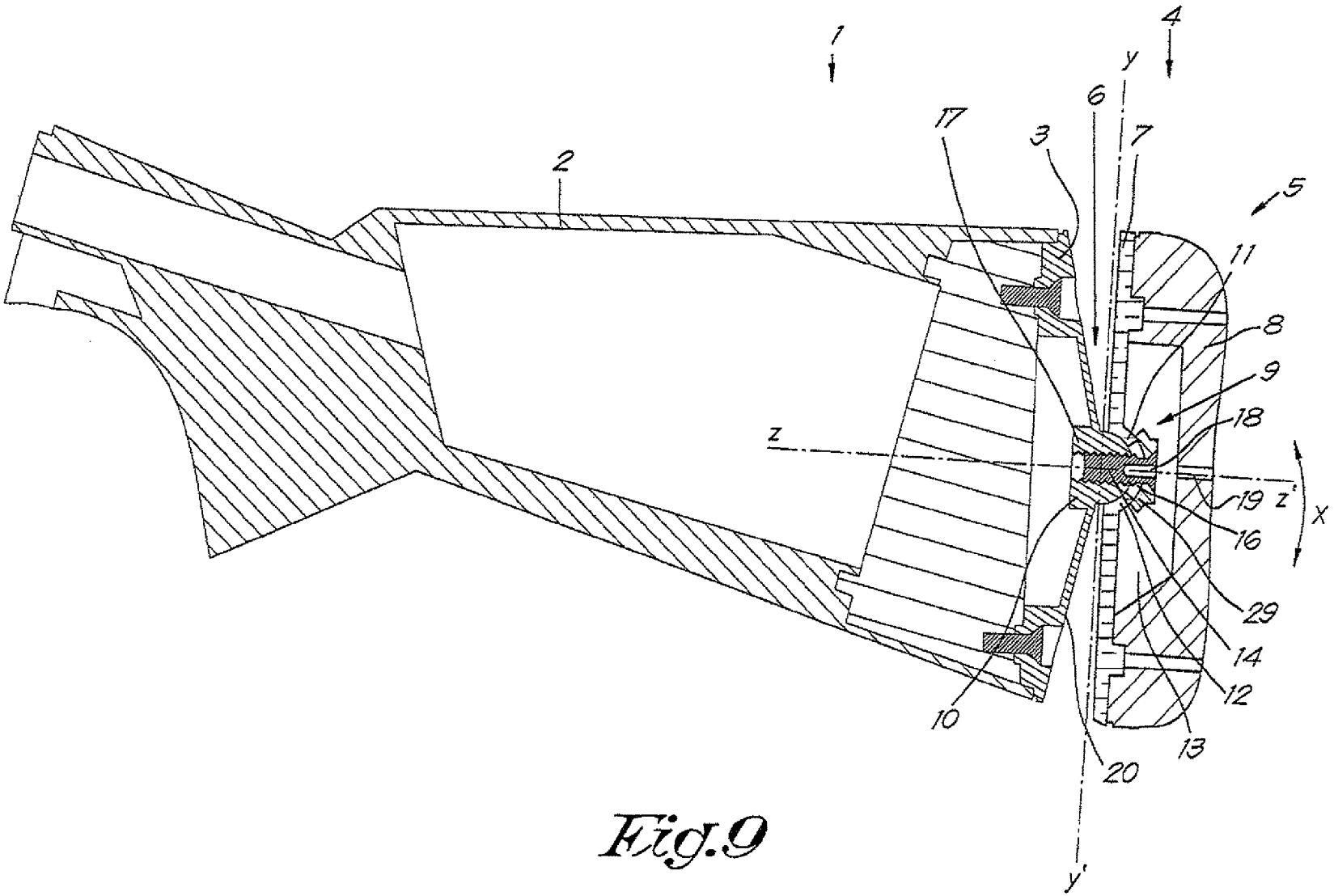
FIG. 9 shows a longitudinal cross-section of another variant of a butt according to the invention.

Another embodiment of a butt 1 with a recoil pad 5 according to the invention is shown in FIG. 9 in which the means 6 are realised by a single ball joint 9, but which differs from the ball joint 9 of FIG. 1 by the fact that the spherical protuberance 10 and the spherical hollow 11 are reversed, with the spherical hollow being realised by a wall 12 forming part of the support plate 7.

The bolt 14 is now screwed into a thread of the protuberance 10, acting as a nut 17, through a spherical washer 29 and an opening 16 in the wall 12 of the support plate 7.

Nothing prevents the rear surface 20 of the butt 1 from being flat and the support plate 7 from having a conical shape, or alternatively that they both have a conical shape or even that neither of them has a conical shape, if the limitations of the rotations are realised in the means 6 themselves, for example in the ball joint 9 or in the articulation 22.

Figure 10:
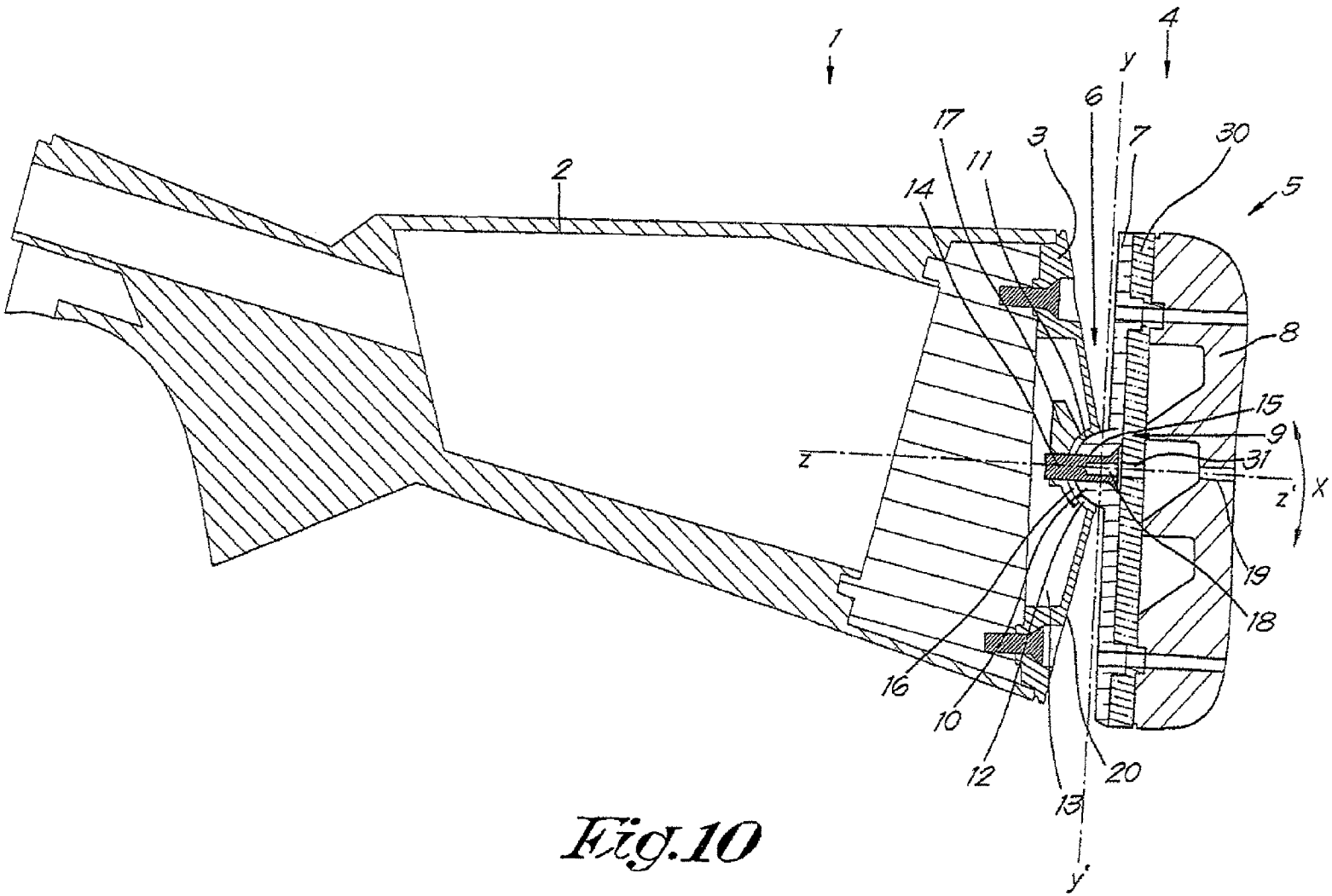
FIG. 10 represents a variant of the butt with the recoil pad according to FIG. 1.

According to another characteristic of the invention the recoil pad assembly 4 is provided with a set of spacers 30 enabling the length of the butt 1 to be varied, for example by insertion between the recoil pad 5 and the support plate 7 as represented in FIG. 10, or by insertion between the body 2 of the butt 1 and the base plate 3.

In case of a spacer 30 between the recoil pad 5 and the support plate 7, this spacer 30 is provided with a passage 31 allowing the locking tool to pass for locking the ball joint 9 by screwing the bolt 14.

Figure 11:
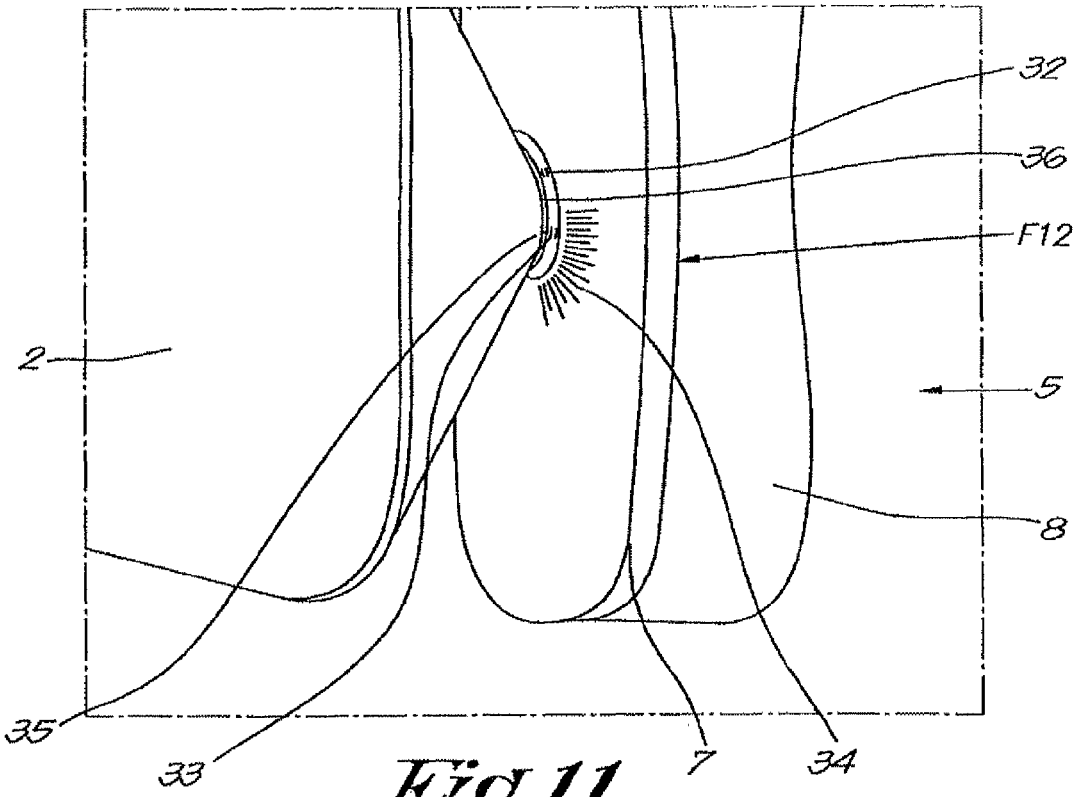
FIG. 11 is an illustration of an alternative which is provided with graduations.
Figure 12:
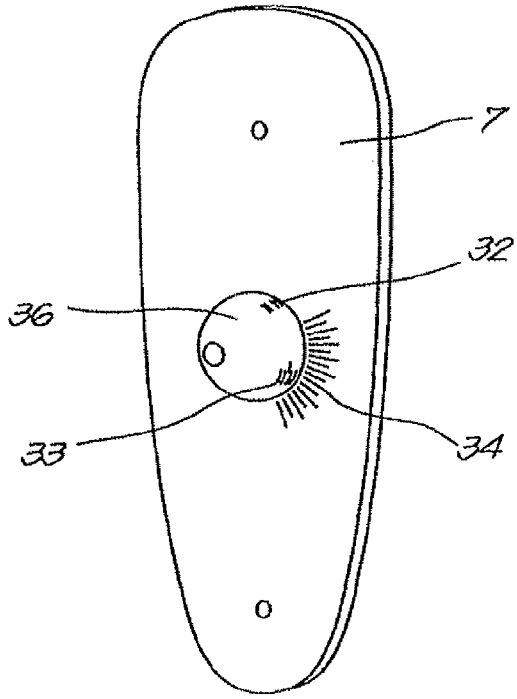
FIG. 12 represents the recoil pad indicated by the arrow F12 in FIG. 11 in a dismantled state.

FIG. 11 shows a variant of the recoil pad 5 of the FIGS. 1 to 6 which is additionally provided with three graduations 32, 33, and 34 for locating the position of the recoil pad 5 relative to a neutral position.

It concerns respectively a graduation 32 for indication of the tilting position of the recoil pad 5 around the transverse axis X-X', a graduation 33 for indication of the lateral rotational position of the recoil pad 5 around the yaw axis Y-Y' and a graduation 34 for indication of the rotational position of the recoil pad 5 around the longitudinal axis (Z-Z').

The reading of the position of a mark for each of the graduations, for example the position of a mark 35 for the graduation 34, enables to identify a particular position of the recoil pad 5 and to reposition the recoil pad 5 at any time to said same position by repositioning the marks in the same position relative to the graduations 32, 33 and 34.

The mark for the graduations 32 and 33 can be formed by the rim 36 of the spherical hollow 11.

It is clear that the invention is by no means limited to the examples described above, but that many modifications may be made to the butt with recoil pad according to the invention for a shoulder-held firearm, without departing from the scope of the invention as defined in the following claims.

The invention claimed is:

1. A butt with recoil pad for a shoulder-held firearm, said butt comprising a body and a recoil pad mounted on a rear of the butt, wherein the recoil pad is mounted on the butt by a single ball joint configured to enable a position of the recoil pad to be adjusted with respect to the butt so as to enable personalization of the position of the recoil pad for a shooter with respect to an average position in which the recoil pad is primarily located in alignment with the butt, said ball joint comprising a spherical protuberance of the recoil pad or of the butt, said protuberance being housed in a spherical hollow of the butt or the recoil pad, respectively, said spherical hollow comprising a wall, and the spherical protuberance being retained in the spherical hollow by a bolt going through the wall through an opening and a nut into which the bolt is screwed.

2. The butt according to claim 1, wherein the ball joint is configured to enable a rotation of the recoil pad to adjust the incline of the recoil pad in an average plane of symmetry of the butt.

3. The butt according to claim 2, wherein the ball joint is configured to enable a rotation of the recoil pad around a transverse axis X-X' of at least five degrees with respect to the average position.

4. The butt according to claim 1, wherein the ball joint is configured to enable a lateral rotation of the recoil pad around a yaw axis Y-Y' essentially located in an average plane of symmetry of the butt.

5. The butt according to claim 4, wherein the ball joint is configured to enable a rotation of the recoil pad around a yaw axis Y-Y' of at least four degrees with respect to the average position.

6. The butt according to claim 1, wherein the ball joint is configured to enable a rotation of the recoil pad around a longitudinal axis Z-Z' located in an average plane of symmetry of the butt.

7. The butt according to claim 6, wherein the ball joint is configured to enable a rotation of the recoil pad around the longitudinal axis Z-Z' of at least ten degrees with respect to the average position.

8. The butt according to claim 3, wherein the axes of rotation essentially intersect at a point.

9. The butt according to claim 1, wherein the ball joint is locked so as to enable one to fix the position of the recoil pad with respect to the butt in a chosen position.

10. The butt according to claim 9, wherein a stroke of the bolt is sufficient to allow to lock the recoil pad in a position relative to the butt by locking the nut against the wall by tightening the bolt.

11. The butt according to claim 10, wherein the head of the bolt is accessible for a tightening tool through a passage in the recoil pad.

12. The butt according to claim 1, wherein the ball joint is essentially located in a center of the rear surface of the butt and in a center of the front surface of the recoil pad opposite the rear surface of the butt.

13. The butt according to claim 12, wherein at least one of the rear surface of the butt and the front surface of the recoil pad has a convergent conical shape located towards the outside and the ball joint is located at a point of convergence of said surface or surfaces.

14. The butt according to claim 1, wherein the recoil pad and the ball joint are mounted on a base plate mounted on the body of the butt to act as a rear surface of the butt.

15. The butt according to claim 1, wherein the butt is provided with a set of spacers enabling a length of the butt to be adjusted.

16. The butt according to claim 1, wherein the butt is provided with at least one graduation configured to enable one to identify a position of rotation of the recoil pad around at least one axis of rotation.

17. The butt according to claim 1, wherein the butt is provided with three graduations configured to enable one to identify the position of rotation of the recoil pad around three orthogonal axis of rotation.

18. A recoil pad assembly comprising:

a base plate configured to be mounted on a body of a butt and comprising a recoil pad mounted on the base plate by a single ball joint configured to enable a position of the recoil pad to be adjusted with respect to the base plate so as to enable one to personalise the position of the recoil pad for a shooter with respect to an average position of the recoil pad, wherein the ball joint is formed by a spherical protuberance of the recoil pad or of the butt, said spherical protuberance being housed in a spherical hollow of the recoil pad or the butt, respectively, said spherical hollow being formed by a wall, and wherein the spherical protuberance is retained in the spherical hollow by a bolt going through the wall through an opening and a nut into which the bolt is screwed.

* * * * *